United States Patent [19]

Wang

[11] Patent Number: 4,939,628

[45] Date of Patent: Jul. 3, 1990

[54] SWITCH MECHANISM FOR A FLASHLIGHT

[76] Inventor: Howard Wang, No. 7, Alley 14, Lane 64, Ching Ping Rd., Chung Ho City, Taipei Hsien, Taiwan

[21] Appl. No.: 439,481

[22] Filed: Nov. 21, 1989

[51] Int. Cl.[5] ..... F21L 7/00

[52] U.S. Cl. ..... 362/206; 200/60

[58] Field of Search ..... 362/204, 205, 206, 295; 200/60

[56] References Cited

U.S. PATENT DOCUMENTS 4,484,253 11/1984 Roberts ..... 362/206

*Primary Examiner*—Allen M. Ostrager

*Attorney, Agent, or Firm*—Fitch, Even, Tabin & Flannery

[57] ABSTRACT

A switch mechanism for a flashlight is disposed in an end cap on a rear end of the flashlight. The switch mechanism includes a plunger cylinder fitted within the end cap, an annular ring being force-fitted on a front end of the plunger cylinder, a guide with a number of guide blocks and a cam surface being slidable in the plunger cylinder, a plunger with a number of ribs and a cam surface being slidable in the guide, a contact element passing through the annular ring, and a spring being biased between a rearmost battery and the contact element. The contact element is pushed to overcome a biasing force of the spring and is contactable with the annular ring by depressing the guide.

3 Claims, 4 Drawing Sheets

SWITCH MECHANISM FOR A FLASHLIGHT

BACKGROUND OF THE INVENTION

The present invention relates to a switch mechanism, and more particularly to a switch mechanism for a flashlight.

A flashlight having a switch mechanism is disclosed in PCT publication No. WO88/01359, publication date: 25 Feb. 1988 (application No. PCT/US87/02032, priority date: 15 Aug. 1986, "Miniature flashlight", Lite Tek International Corp.). The switch mechanism includes a plunger cylinder, a plunger, a button, an annular ring, a diaphragm, a shorting member, a spring, a contact housing, a battery-cavity contact and a cavity-end cap contact. The conventional arrangement is very complex and difficult to manufacture.

The present invention has arisen to mitigate and/or obviate the afore-described disadvantages of the conventional switch mechanism for flashlights.

SUMMARY OF THE INVENTION

The primary objective of the present invention is to provide a switch mechanism for a flashlight which has a relatively simple configuration and has a low manufacturing cost.

In accordance with one aspect of the invention, there is provided a switch mechanism for a flashlight including a plunger cylinder fitted within an end cap which is threadedly engaged on a rear end of the flashlight, an annular ring being force-fitted on a front end of the plunger cylinder, a guide with a number of guide blocks and a cam surface being slidable in the plunger cylinder, a plunger with a number of ribs and a cam surface being slidable in the guide, a contact element passing through the annular ring, and a spring being biased between a rearmost battery and the contact element. The contact element is pushed to overcome a biasing force of the spring and is contactable with the annular ring by depressing the guide so as to turn on and turn off the flashlight.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
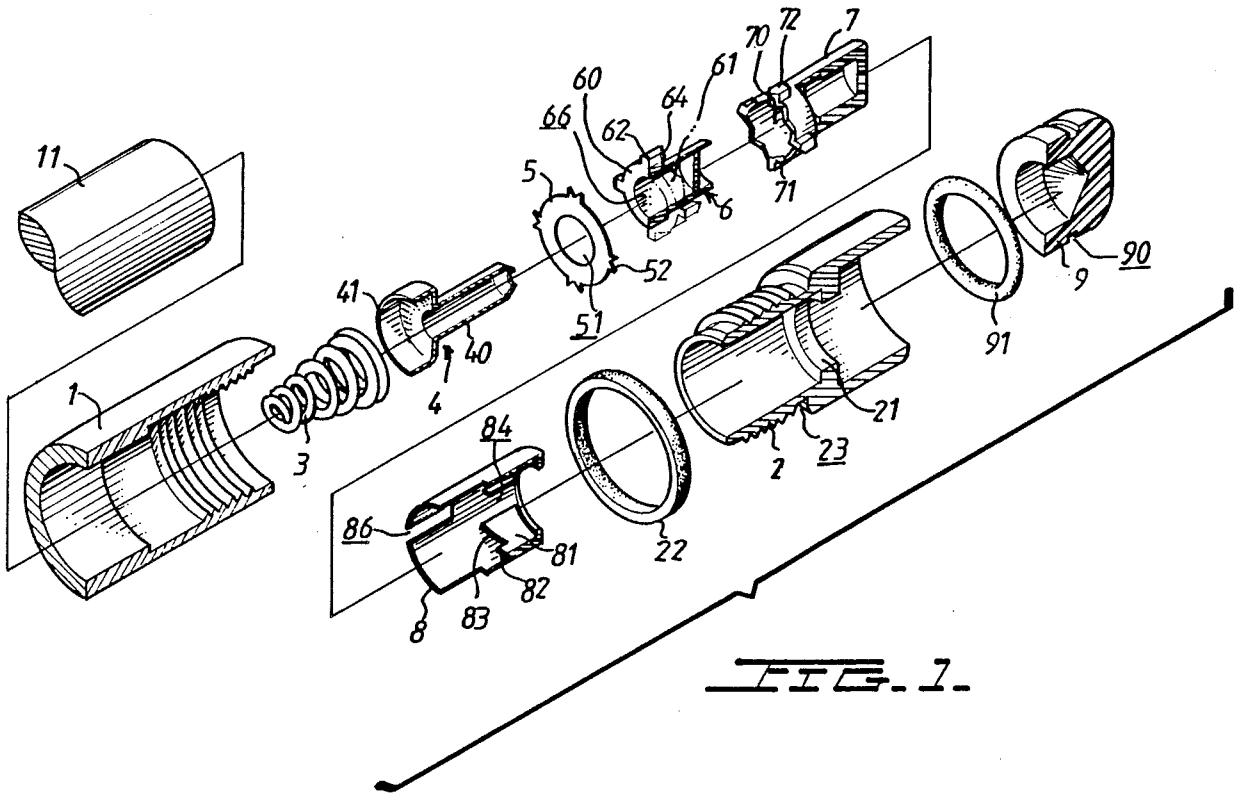
FIG. 1 is an exploded view of a switch mechanism for a flashlight in accordance with the present invention.
Figure 2:
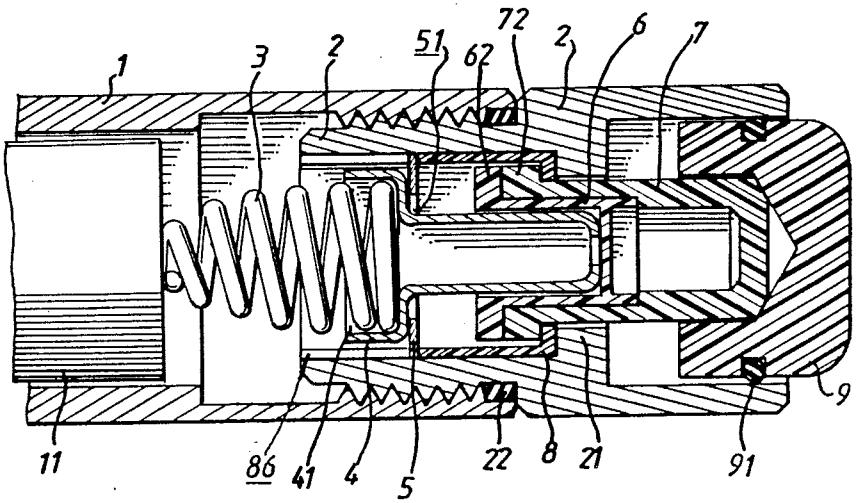
FIG. 2 is a cross-sectional view of the switch mechanism of FIG. 1.

Referring to the drawings and initially to FIGS. 1 and 2, the switch mechanism for a flashlight in accordance with the present invention is generally provided in a rear end of a flashlight. The switch mechanism comprises an end cap 2 threadedly engaged in a rear end of a cylindrical tube 1. The cylindrical tube 1 contains, in sequence from a front end thereof, a plurality of batteries 11, a spring 3, a contact element 4, an annular ring 5, a plunger 6, a guide 7, a plunger cylinder 8 and a button 9 disposed in the end cap 2. The spring 3 biases the batteries 11 away from the switch mechanism in accordance with the present invention and biases the contact element 4 to make an electrical contact with the annular ring 5. By depressing the button 9, the plunger 6 is pushed against the contact element 4 to overcome the bias of the spring 3 so that the contact element 4 is pushed to be separated from the annular ring 5. The flashlight is thus shut off.

A radially inward extending annular flange 21 is formed in a middle portion of the end cap 2. A sealing ring 22 is fitted within an annular groove 23 on an outer surface of the end cap 2 in order to form a fluid-tight seal between the end cap 2 and the cylindrical tube 1. The button 9 is cup-shaped and has an annular groove 90 on an outer surface thereof for receiving a sealing ring 91 so that the button 9 is frictionally fitted in a rear end of the end cap 2.

The plunger cylinder 8 which has a radially inward extending annular flange 81 formed in a rear end thereof is snugly fitted within a front end of the end cap 2 such that the rear end of plunger cylinder 8 contacts the annular flange 21 of the end cap 2. Four guide elements 82 are formed in the plunger cylinder 8 proximate to the annular flange 81. An axially extending recess 84 is formed between every two of the guide elements 82. A can surface 83 is formed on a front end of each guide element 82. Four axially extending notches 86 are formed in, and equally distributed around a front portion of the plunger cylinder 8 and are open forwards.

Four radially outward extending dove-tail shaped protrusions 52 are formed on an outer peripheral surface of the annular ring 5 which has a center hole 51 therethrough. The protrusions 52 of the annular ring 5 are force-fitted into the respective notches 86 of the plunger cylinder 8 so that the plunger cylinder 8 is solidly retained in position thereby. The annular ring 5 is electrically connected to the end cap 2 which is electrically connected to an anode of a frontmost battery 11 via the cylindrical tube 1. The contact element 4 has a tube portion 40 and an enlarged diameter portion 41 formed at a front end of the tube portion 40. The tube portion 40 of the contact element 4 passes through the center hole 51 of the annular ring 5. The spring 3 is electrically connected between a cathode of a rearmost battery 11 and the enlarged diameter portion 41 of the contact element 4 and biases the contact element 4 to make an electrical contact with the annular ring 5.

The plunger 6 has a shaft portion 61. Four radially outward extending ribs 62 are formed on an outer peripheral surface of a head portion 60 of the plunger 6. The outer diameter of the head portion 60 is larger than that of the shaft portion 61 of the plunger 6. A series of axially extending cam surfaces 64, in the form of serrated teeth, are formed on a rear peripheral surface of the head portion 60. The plunger 6 has an open end 66 for receiving the tube portion 40 of the contact element 4. The diameter of the tube portion 40 of the contact element 4 is such that the tube portion 40 is freely rotatable and slidable within the open end 66 of the plunger 6.

Figure 3:
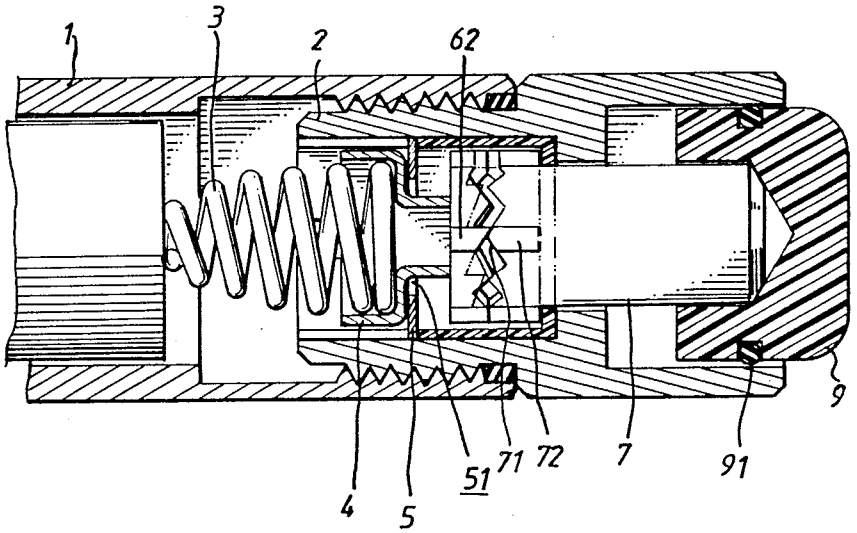
FIGS. 3 and 4 are cross-sectional views, similar to FIG. 2, illustrating working processes of the switch mechanism.

The guide 7 is substantially a cylindrical tube with an open end 70. Around the open end 70 of the guide 7 there are provided a series of radially outward extending guide blocks 72 which also form a series of axially extending cam surfaces 71, in the form of serrated teeth, along the rim of the open end 70 of the guide 7. As best seen in FIG. 3, the guide blocks 72 are as wide as the ribs 62 of the plunger 6 so that the guide blocks 72 and the ribs 62 are receivable within the recesses 84 of the plunger cylinder 8. The diameter of the shaft portion 61 of the plunger 6 is such that the shaft portion 61 is freely rotatable and slidable within the open end 70 of the guide 7. The cam surfaces 64 of the plunger 6 are engageable with the cam surfaces 71 of the guide 7. The rear end of the guide 7 slidably passes through the annular flange 21 of the end cap 2 and is received in a front end of the button 9. The annular flange 81 of the plunger cylinder 8 limits a rearward movement of the guide 7.

It is to be noted that the plunger 6, the guide 7 and the plunger cylinder 8 are nonconductive. As shown in the drawings there are four ribs 62, four guide blocks 72 and four recesses 84. However, it is to be noted that any even number, such as two, four or six etc., of each of the ribs 62, guide blocks 72 and recesses 84 can achieve the same results.

Figure 4:
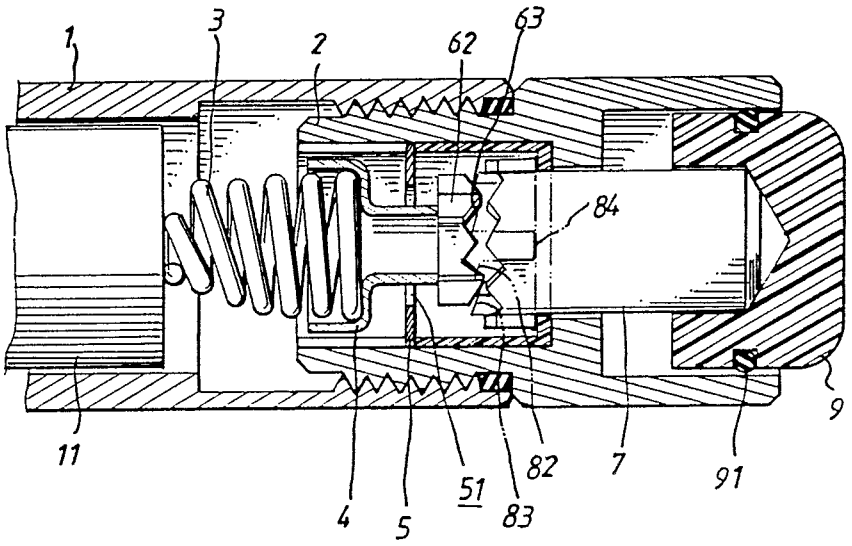

Referring next to FIGS. 1, 3 and 4, the operation of the switch mechanism for a flashlight in accordance with the present invention will now be described. As shown in FIG. 3, the contact element 4 is electrically connected to the cathode of the rearmost battery 11 by the spring 3. The spring 3 biases the contact element 4 to make an electrical contact with the annular flange 5 which is electrically connected to the anode of the frontmost battery 11 through the end cap 2 and the cylindrical tube 1. At this moment, each one rib 62 and each one guide block 72 are received in a respective one recess 84 of the plunger cylinder 8.

If it is desired to turn off the flashlight, it is necessary only that the button 9 be depressed lightly so that the button 9 pushes the contact element 4 to overcome the biasing force of the spring 3. The plunger 6 and the guide 7 are pushed forward by the button 9. When the button 9 is depressed so far that the cam surfaces 64 of the ribs 62 extend out of the recesses 84, the cam surfaces 64 of the ribs 62 are forced to slide sideways and are held by the cam surfaces 83 of the guide elements 82 by the biasing force of the spring 3 as shown in FIG. 4. The contact element 4 is thus separated from the annular ring 5 and the flashlight is turned off.

If it is desired to turn on the flashlight again, it is necessary only to further depress the button 9 until the cam surfaces 64 of the ribs 62 extend from the cam surfaces 83 of the guide elements 82 so that the cam surfaces 64 of the ribs 62 slide along the cam surfaces 83 of the guide elements 82 and slide back into the recesses 84 of the plunger cylinder 8. The contact element 4 is thus electrically contacted with the annular flange 5 again. Accordingly, the configuration of the switch mechanism in accordance with the present invention is greatly simplified as compared with that of the conventional switch mechanism. The manufacturing cost is thus decreased.

Alternatively, the rear end of the guide protrudes out of the rear end of the end cap so that the rear end of the guide can be directly depressed instead of the button.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A switch mechanism for a flashlight, said flashlight having a cylindrical tube for receiving a plurality of batteries; said switch mechanism comprising:

an end cap threadedly engaged to a rear end of said cylindrical tube, a radially inward annular flange being formed on a middle portion of an inner surface of said cylindrical tube;

a plunger cylinder having a number of notches axially formed in a front end thereof, an even number of guide elements each with a front cam surface being formed in a rear end of said plunger cylinder, said plunger cylinder being fitted within a front end of said end cap;

an annular ring having a number of protrusions formed on an outer peripheral surface thereof corresponding to said notches of said plunger cylinder, said protrusions of said annular ring being force-fitted into said notches of said plunger cylinder so that said plunger cylinder is retained between said annular ring and said annular flange of said end cap;

a guide which has an even number of guide blocks and has a first cam surface formed on a front end thereof being slidable in said plunger cylinder, and rear end of said guide protruding out of said end cap;

a plunger which has an even number of ribs and a second cam surface being slidable in said guide such that said first cam surface of said guide is engageable with said second cam surface of said plunger;

a contact element passing through said annular ring and being freely slidable and rotatable within said plunger; and a spring being biased between a rearmost battery and said contact element;

said contact element being pushed to overcome a biasing force of said spring by depressing said rear end of said guide, and said second cam surface of said plunger being engageable with said front cam surface of said plunger cylinder so that said contact element is contactable with said annular ring in order to turn on and turn off said flashlight.

2. A switch mechanism according to claim 1, wherein a button is further frictionally disposed into a rear end of said end cap, a front end of said button is engaged with said rear end of said guide, a rear end of said button protrudes out of said rear end of said end cap so that said contact element is pushed by a depression of said button.

3. A switch mechanism according to claim 1, wherein said protrusions of said annular ring are dove-tail shaped.

* * * * *